US006166388A

United States Patent [19]

Weir et al.

[11] Patent Number: 6,166,388

[45] Date of Patent: Dec. 26, 2000

[54] SOURCE GUIDE TUBE FOR RADIOGRAPHY SOURCE PROJECTOR SYSTEM, SYSTEM CONTAINING TUBE AND FLEXIBLE RADIATION ATTENUATING SLEEVE FOR A TUBE

[75] Inventors: Donald Weir, Nevilles Cross; John Thomas Hare, Cramlington, both of United Kingdom

[73] Assignee: Illinois Tool Works Inc., Glenview, Ill.

[21] Appl. No.: 09/117,205

[22] PCT Filed: Jan. 24, 1997

[86] PCT No.: PCT/GB97/00219

§ 371 Date: Jul. 24, 1998

§ 102(e) Date: Jul. 24, 1998

[87] PCT Pub. No.: WO97/27596

PCT Pub. Date: Jul. 31, 1997

[30] Foreign Application Priority Data

Jan. 25, 1996 [GB] United Kingdom ..... 9601502

[51] Int. Cl.[7] ..... G21F 5/02; G21F 3/02

[52] U.S. Cl. ..... 250/497.1; 250/519.1

[58] Field of Search ..... 250/497.1, 496.1, 250/519.1

[56] References Cited

U.S. PATENT DOCUMENTS

| | | | |
|---|---|---|---|
| 2,960,561 | 11/1960 | Plummer | 250/519.1 |
| 3,032,661 | 5/1962 | Wolf | 250/108 |
| 3,536,920 | 10/1970 | Sedlak et al. | 250/519.1 |
| 3,608,555 | 9/1971 | Greyson | 250/519.1 |
| 4,225,790 | 9/1980 | Parsons et al. | 250/497.1 |
| 4,606,603 | 8/1986 | Cairns | 350/96.21 |
| 4,837,448 | 6/1989 | Banchelin et al. | 250/519.1 |
| 4,943,731 | 7/1990 | Brown | 250/497 |
| 5,012,114 | 4/1991 | Sisson . | |
| 5,525,408 | 6/1996 | Weir et al. | 250/519.1 |

FOREIGN PATENT DOCUMENTS

| | | |
|---|---|---|
| 0012004 | 6/1980 | European Pat. Off. . |
| 0012005 | 6/1980 | European Pat. Off. . |
| 0649148 | 4/1995 | European Pat. Off. . |
| 1962747 | 12/1970 | Germany . |
| 904988 | 9/1962 | United Kingdom . |
| 914229 | 12/1962 | United Kingdom . |
| 8900831 | 2/1989 | WIPO . |

*Primary Examiner*—Bruce C. Anderson
*Attorney, Agent, or Firm*—Hodgson, Russ, Andrews, Woods & Goodyear, LLP

[57] ABSTRACT

A radiation shield (2) for a flexible tube such as a source guide tube (4) of a radiography projector system, said shield comprising a flexible sleeve (6) comprising an axial assembly of axially overlapping tubular units (10) of elastomeric material containing particles of radiation attenuating material. In a preferred embodiment, the tubular units each comprise a female section and a male section disposed at opposite ends of the unit, said male section being adapted to be a push fit into the female section of a like unit. The sleeve is preferably protected by a sheath (8) e.g. of a braided metal wire. Also described is a flexible source guide tube assembly for use with a radiography source projector system, said assembly comprising a flexible source guide tube within a radiation shield in the form of a flexible sleeve for the tube, said sleeve comprising elastomeric material containing particles of radiation attenuation material.

10 Claims, 2 Drawing Sheets

Figure 1:
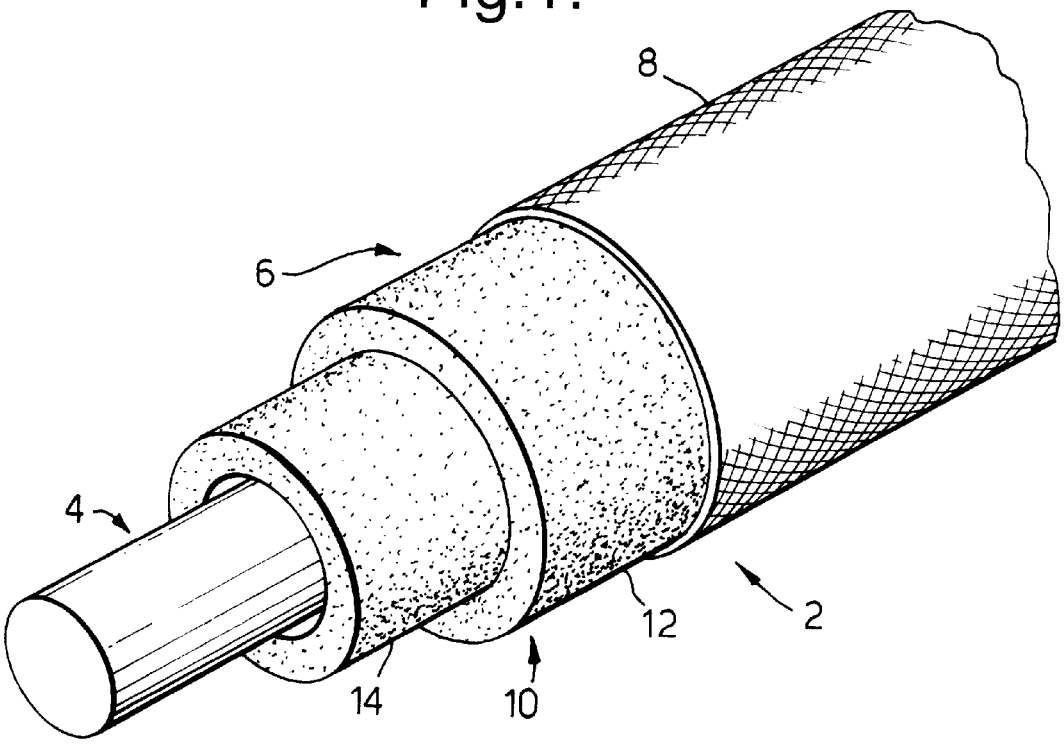

SOURCE GUIDE TUBE FOR RADIOGRAPHY SOURCE PROJECTOR SYSTEM, SYSTEM CONTAINING TUBE AND FLEXIBLE RADIATION ATTENUATING SLEEVE FOR A TUBE

This invention relates to improvements in or relating to radiography source projector systems such as are used for non-destructive testing of structures.

In general, these systems comprise a housing within which a radiation source, e.g. a radioactive isotope, is located when out of use, a source guide tube attached to the housing and through which the source is advanced in operation to the desired point of use, and drive means for advancing the source out of the housing through the tube to the point of use and retracting the source back through the tube and into the housing. The housing is provided with a radiation shield such as depleted uranium to protect operators from radiation when the source is not in use.

Any suitable drive means may be used. By way of example, the drive means may be a cable wound on to a rotatable drum and having a holder for the radiation source attached to its free end. The source may thus be advanced from the housing along the tube by rotating the drum in a direction to unwind the cable and may be retracted back into the housing by rotating the drum in the reverse direction.

The source guide tube, which may be several meters long, is usually detachable from the housing for ease of transport.

An example of such a system is the Amersham Sentinel system (Sentinel is a Registered Trade Mark).

As stated above, when the source is not in use, it is located in the housing which is provided with a radiation shield which protects the operator from radiation.

Where the source guide tube is rigid, it has been proposed to encase it in radiation attenuating material such as lead so as to provide shielding from radiation while the radiation source is being advanced along the tube to the point of use.

However, in many cases it is desired for the source guide to be flexible so as to enable the source to be positioned in locations remote from the housing where access is difficult and it is necessary, for example, to bend the tube round corners to avoid obstacles. Despite the availability of these systems for several years, it has not been found possible hitherto to provide the tube with any significant level of shielding. Thus, while the source is being moved along the tube there tends to be an unacceptable level of radiation. This is a serious cause for concern, especially if, for example, the source jams in the tube. The current practice when this happens is to provide temporary shielding, e.g. by burying a length of tube within which the source is located in a pile of lead shot.

The present invention is designed to overcome this problem.

According to the present invention, there is provided a flexible source guide tube assembly for use with a radiography source projector system, said assembly comprising a flexible source guide tube within a radiation shield in the form of a flexible sleeve for the tube, said sleeve comprising elastomeric material containing particles of radiation attenuation material.

Where a collimator is attached to one end of the source guide tube, the sleeve may extend over the collimator, if desired.

The invention further provides a radiography source projector system including such an assembly.

In one preferred embodiment of the invention, the radiation shield comprises an axial assembly of axially overlapping tubular units of elastomeric material containing particles of radiation attenuating material.

The invention thus also provides a radiation shield for a flexible tube such as a source guide tube of a radiography source projector system, said shield comprising a flexible sleeve on said tube, said sleeve comprising an axial assembly of axially overlapping tubular units of elastomeric material containing particles of radiation attenuating material.

Preferably the tubular units are plugged together axially. For example, the tubular units may each comprise a female section and a male section disposed respectively at opposite ends of the unit, said male section being adapted to be a push fit into the female section of a like unit.

Figure 3:
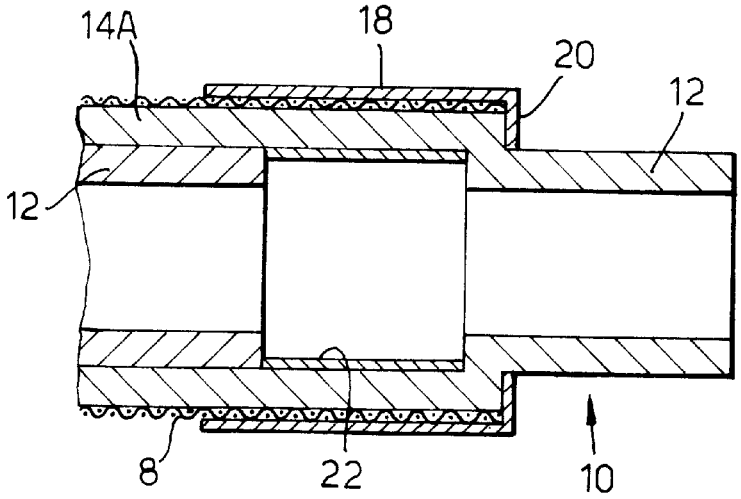

The invention will now be illustrated with reference to preferred embodiments thereof and with the aid of the accompanying drawings in which:

FIG. 1 is a perspective view, part cut away, of a flexible source guide tube assembly incorporating a sleeve according to the invention; and FIG. 2 is a cross-sectional view through a preferred embodiment of the sleeve of the invention; and FIG. 3 is a cross-sectional view through one end of a preferred assembly of radiation sleeve and protective sheath.

Referring first to FIG. 1, the assembly 2 comprises a flexible source guide tube 4 (sometimes known as a windout tube), flexible elastomeric sleeve 6 and optional protective sheath 8.

FIG. 2 shows a preferred form of the sleeve comprising an axial assembly of axially overlapping hollow tubular sleeve units plugged together.

Suitably the units each comprise a female section and a male section disposed at opposed ends of the unit, the male section being adapted to be a push fit, preferably a sliding interference fit, into the female section. Preferably, the units are so shaped that when a plurality of the units are connected together by plugging the male section of one into the female section of the next, a sleeve of substantially uniform wall thickness, and preferably also substantially uniform diameter, is obtained.

Figure 2A:
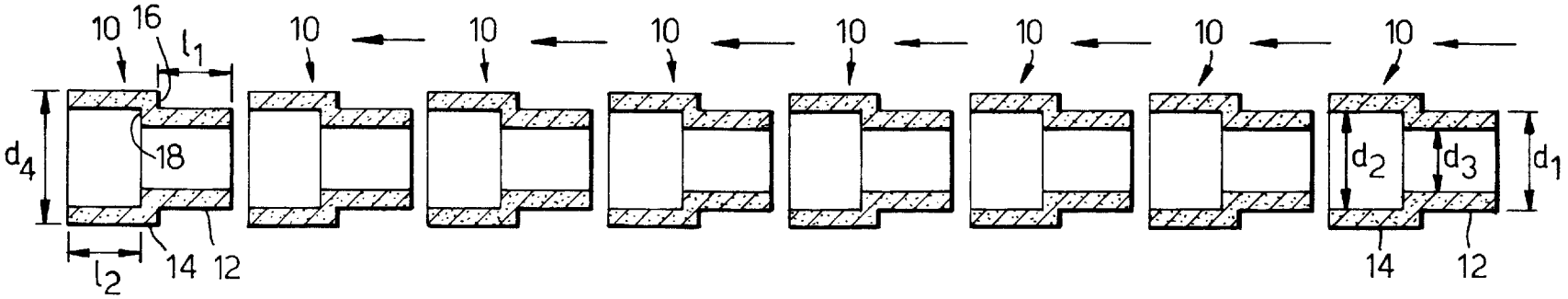
Figure 2B:
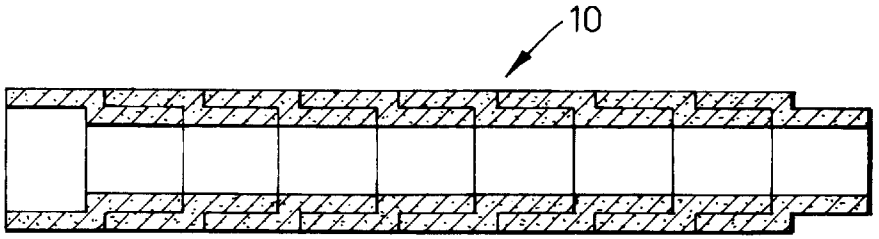

While the units may take any suitable form, in the embodiment illustrated in FIG. 2, the assembled sleeve comprises an assembly of stepped sleeve units 10 which are shown in FIG. 2A in exploded form and in FIG. 2B in assembled form. Each stepped sleeve unit comprises two cylindrical sections 12,14 of differing internal and external diameters wherein the external diameter $d_1$ of the smaller diameter, male, section 12 is chosen to be the same or substantially the same as the internal diameter $d_2$ of the larger diameter section whereby the male section 12 of one sleeve unit is a tight push fit in the female section 14 of a like sleeve unit, preferably with a slight interference.

The internal diameter $d_3$ of the smaller diameter section 12 is chosen to be a close sliding fit over the source guide tube. The external diameter $d_1$ of the smaller diameter section is chosen such that the wall thickness t of this section (where $t=d_1-d_3$) is sufficient in combination with the chosen composition of the elastomeric sleeve, to provide the required minimum radiation attenuation, whereby this minimum level of attenuation is maintained even when the sleeve is bent into a curve so that one side is in tension and gaps may open up between the female sections of adjacent units on that side of the sleeve.

The external axial length $l_1$ of the smaller diameter section 12 of the unit, as measured from the external shoulder 16, is designed to be substantially equal to the internal length $l_2$ of the larger diameter section 14, as measured from internal shoulder 18, so that when a plurality of units are joined together by inserting the smaller diameter section 12 of each unit into the recess of the larger diameter section 14 of another unit, a substantially continuous sleeve having a substantially uniform wall thickness T, where T is $d_4-d_3$, and substantially uniform diameter $d_4$ is obtained.

Substantially any desired length of sleeve may be formed by suitable choice of length of sleeve unit 10 and the number of such sleeve units which are assembled together. Sleeves may also be formed from units of differing lengths. For example, it may be desirable to have a central sleeve section formed of units of relatively short length between two end sleeve pieces formed of units of relatively greater length.

Sleeves may be obtained having each end terminated by the same kind of section (male or female) by providing a connecting unit in the form of a cylindrical tubular part having the outer diameter of the male section or the inner diameter of the female section, respectively. Conveniently the length of the part will be about $21_1$, or $21_2$.

The units may be formed of any suitable elastomeric composition which at the desired wall thickness gives a desired level of radiation attenuation. Any suitable elastomer may be employed as the matrix in which the radiation attenuation material is dispersed; e.g. polyurethane, natural or synthetic rubber, plasticised pvc or silicone elastomer; however, silicone elastomer is preferred for its strength, resistance to tearing, flexibility and freedom from ions such as nitrogen, phosphorus, halide and sulphide whose presence is undesirable in some applications. Moreover silicone elastomers are known which retain their desirable elastomeric properties over a wide temperature range, enabling the apparatus to be used over a wide range of climatic conditions, from arctic to tropical. Furthermore, the sleeve units are readily mouldable from silicone elastomer using simple inexpensive moulds and without the need for high temperatures and pressures.

The particles may be of any suitable radiation attenuating material and will be chosen according to the nature of the radiation to be attenuated; however, lead is particularly preferred for gamma radiation because of its high density, low cost per unit of density relative to other materials and its compatibility with the preferred elastomer, namely silicone elastomer.

The proportion of particles to elastomer will vary according to the radiation attenuation effectiveness of the material forming the particles, the thickness of the sleeve and the desired level of attenuation but in general it is desired to use as high a proportion as possible concomitant with maintaining cohesiveness of the composition of particles and elastomer so as to achieve the desired level of attenuation with the minimum thickness of sleeve. Generally, the particles will form up to about 60% by volume of the total of particles and elastomer. When lead powder is employed, the amount of lead is preferably about 60 to 90% by weight of the total.

Fillers other than the radiation attenuating particles and/or other additives may be included in the elastomeric composition. Reinforcement may also be included, e.g. in the form of chopped fibrous material, rovings or woven or unwoven webs.

The sleeve is formed from a plurality of the sleeve units by pushing the male section to one unit into the female section of the next. It is preferred not to bond the units to each other as this inhibits flexibility. However, it is desirable to provide means for inhibiting the units from separating axially. This may be achieved in part by the tightness of the fit of the male section within the female section. The use of an elastomer with a high surface friction provides further assistance.

As shown in FIGS. 1 and 3, the assembled sleeve 6 is preferably protected by protective sheath 8 which may be of any suitable flexible material used for the protection of plastics or rubber tubes, e.g. braided metal wire. This sheath may suitably provide the means for constraining the units from which the sleeve is formed from separating axially. For example, the sheath may be substantially inelastic and attached to the sleeve at each end. As illustrated in FIG. 3, the attachment may be effected, for example, by means of a ferrule 18 swaged or otherwise attached to the end of the sheath 8, and having a lip 20 which extends over the shoulder of the endmost unit.

It is also preferred to reinforce the sleeve assembly at each end so as to assist its attachment to the guide tube and to prevent collapse during swaging where there is used. As illustrated in FIG. 3, this may suitably be achieved by the insertion of a rigid spacer unit 22. To this end, the inside length of the female section 14A of the unit 10 forming the end of the sleeve is increased to $l_1+l_3$ where $l_1$ is the external length of the male section and $l_3$ is the length of the spacer. The spacer may be of any suitable material, e.g. stainless steel.

Preferably, the length of the sheath relative to that of the sleeve is selected so that the sleeve is held under slight axial compression.

The sleeve 6 or sub assembly of sleeve 6 and protective sheath 8 (where used) may be fixed in position over source guide tube 4 in any suitable manner. For example, each end of the sleeve or sub-assembly may be fixed to the tube 4, e.g. by clamps or by means of grub screws screwed into the sleeve 6 to make frictional contact with the outside of the tube 4. Other means of attaching the sleeve or sub assembly to the source guide will be apparent to those skilled in the art.

While the invention has been described with particular relevance to radiography source projector systems such as use radioactive isotopes e.g. if iridium, cobalt or ytterbium, it will be understood that the sleeves are also suitable for use for shielding sources of other high energy shortwave electromagnetic radiations, neutrons, etc.

In one example of the invention, a sleeve 90 cm long and having a 10 mm overall wall thickness ($d_1-d_3=d_4-d_2=5$ mm) was assembled from 32 units having the shape illustrated in FIG. 2 and an overall length of 50 mm. The units were each moulded from a composition of Silastic S silicone elastomer containing about 85% by weight of lead powder. Silastic is a Registered Trade Mark of Down Corning Corporation. The sleeve was fitted with a protective shield of braided steel wire and the assembly was fitted over a source guide tube for iridium 192 isotope. Based on measurements on a 5 mm thick sheet of the composition employed to form the units, the minimum recorded value for attenuation of the radiation from the isotope within source guide tube will be 43%. This is equivalent to approximately 2.3 mm of lead. The average value for attenuation is about 50%. The assembly of source guide tube, sleeve and protective outer could be flexed to the same extent as the source guide tube alone.

What is claimed is:

1. A flexible source guide tube assembly for use with a radiography source projector system, said assembly comprising a flexible source guide tube within a radiation shield in the form of a flexible sleeve for the tube, said sleeve comprising elastomeric material containing particles of radiation attenuation material.

2. A radiation shield for a flexible tube such as a source guide tube of a radiography projector system and suitable for used in the assembly claimed in claim 1, said shield comprising a flexible sleeve comprising an axial assembly of axially overlapping tubular units of elastomeric material containing particles of radiation attenuating material.

3. A radiation shield as claimed in claim 2 characterised in that said tubular units are plugged together axially.

4. A radiation shield as claimed in claim 3 characterised in that said tubular units each comprise a female section and a male section disposed at opposite ends of the unit, said male section being adapted to be a push fit into the female section of a like unit.

5. A radiation shield as claimed in claim 4 characterised in that the male section has an internal diameter $d_3$, and external diameter $d_1$, and an external length $l_1$ and the female section has an internal diameter $d_2$, and external diameter $d_4$ and an internal length $l_2$, wherein $d_2$ is substantially the same as $d_3$ and $l_1$ is substantially the same as $l_2$.

6. A radiation shield as claimed in any one of claims 2 to 5 including an outer protective sheath.

7. A radiation shield as claimed in claim 6 characterised in that the sleeve is constrained by the sheath from expanding axially.

8. An assembly as claimed in claim 1 having a collimator attached to one end of the source guide tube and wherein the sleeve extends over the collimator.

9. A radiography source projector system including an assembly as claimed in claim 1.

10. A flexible source guide tube assembly for use with a radiography source projector system said assembly comprising a flexible source guide tube and a radiation tube shield B.

* * * * *